United States Patent [19]

Duvall

[11] 4,352,482

[45] Oct. 5, 1982

[54] HOT TOPS

[75] Inventor: Paul F. Duvall, Medina, Ohio

[73] Assignee: Foseco Trading AG, Chur, Switzerland

[21] Appl. No.: 137,782

[22] Filed: Apr. 7, 1980

[51] Int. Cl.[3] ..... B22D 7/10

[52] U.S. Cl. ..... 249/106; 249/197

[58] Field of Search ..... 249/106, 197-202, 249/DIG. 5

[56] References Cited

U.S. PATENT DOCUMENTS

| | | | |
|---|---|---|---|
| 1,500,733 | 7/1924 | Howard et al. | 249/198 |
| 1,500,740 | 7/1924 | Howard et al. | 249/198 |
| 3,058,182 | 10/1962 | Urmetz et al. | 249/202 |
| 3,271,000 | 9/1966 | Thiem et al. | 249/197 |
| 3,352,530 | 11/1967 | Thiem | 249/202 |
| 3,512,572 | 5/1970 | Ednell | 164/160 X |
| 3,540,689 | 11/1970 | LaBate | 249/202 X |
| 3,893,645 | 7/1975 | Marcec | 249/202 |

FOREIGN PATENT DOCUMENTS

| | | | |
|---|---|---|---|
| 722536 | 1/1955 | United Kingdom | 249/201 |
| 936682 | 9/1963 | United Kingdom | 249/106 |
| 2001340 | 1/1979 | United Kingdom . | |

*Primary Examiner*—Gus T. Hampilos
*Assistant Examiner*—J. Reed Batten, Jr.
*Attorney, Agent, or Firm*—Cushman, Darby & Cushman

[57] ABSTRACT

A hot top lining for use in casting metal ingots is positioned in the mouth of the mould or in a head box at the top of the mould and comprises a plurality of refractory, heat-insulating lining slabs at least one of which has, at its outward-facing surface and adjacent to its lower edge, at least two ribs extending horizontally across the slab to inhibit upward flow of molten metal behind the slab. The ribbed slabs themselves form a part of the invention.

5 Claims, 5 Drawing Figures

HOT TOPS

The invention concerns hot tops for metallurgical moulds, in particular for ingot moulds, especially for casting steel.

In casting steel ingots it is desirable to keep the metal at the head of the mould molten whilst the metal in the body of the mould is cooling and solidifying, because the metal in the body of the mould shrinks as it cools and solidifies and, if the head metal is kept molten, the head metal feeds down into the ingot body and achieves the desirable effect of inhibiting the formation of shrinkage cavities in the body of the ingot. The head metal may be kept molten by use of a hot top and this may comprise a number of refractory, heat-insulating slabs (which may contain exothermic matter) positioned as a lining in the head of the mould or in a separate head box at the top of the mould. Usually the faces of the slabs are substantially flat.

According to the present invention an assembly for casting ingots comprises an ingot mould and a hot top comprising a number of refractory, heat-insulating lining slabs positioned against the inner surface of the walls of the mould mouth or against the inner surface of the walls of a head box at the top of the mould, at least one of the slabs having at its outward-facing surface adjacent to the lower edge of the slab at least two ribs, extending horizontally across the slab and disposed and arranged progressively to inhibit upward flow of molten metal behind the slab.

Hot top lining slabs are held in place by a variety of expedients e.g. clips, wedging and adhesives but there is always some risk of the slabs being insufficiently firmly and closely held in place. In particular, during casting there is a risk of molten metal rising behind the slab: this can result in the slab becoming completely dislodged and the hot top therefore not functioning properly or, even if the slab is not completely dislodged, the efficiency of the hot top is reduced and problems arise during rolling the ingot.

In the case of the present invention, if some molten metal rises behind a slab past the lowermost rib, the molten metal then flows into a relatively large cavity, namely the space between the lowermost rib and the next rib and this results in a pressure drop in the metal. The pressure drop reduces the likelihood of the molten metal penetrating behind the second rib and, in any event, because any space behind the rib is restricted, localised chilling of the metal tends to occur to create a solidified metal seal before the rib. Any further rib and preceding space further reduces, in a similar way, the risk of continued penetration of molten metal behind the slab.

During use, ingot mould wall surfaces become worn and acquire accretions and surface irregularities make it difficult to hold a top top lining slab firmly and closely against the surface. Furthermore, hot top slabs are difficult to produce with fine tolerances and this also makes it difficult to hold the slabs firmly and closely against the mould wall. The fact that the slabs used in accordance with the invention have the horizontally extending ribs renders them more deformable in some directions than conventional slabs of the same overall thickness and the ribs can be brought into good contact with even an irregular mould wall surface, thereby achieving good resistance to molten metal rising behind the slabs. In contrast, conventional slabs rely on a large area of surface contact with the mould wall to provide resistance to penetration of molten metal up behind the slabs and, as the mould wall may be irregular and the slab made to poor tolerances and not easily deformed, the desired surface contact may not be achieved and, therefore, inadequate penetration-resistance may result.

The outward extent of the ribs from the face of the body of the slab, i.e. the height of the ribs, is preferably from $\frac{1}{8}$ to $\frac{1}{4}$ of an inch. In any event the width of the ribs is preferably from 0.5 to 1.5 times the height of the rib and the width of the space between adjacent ribs is preferably 1 to 6 times the rib height.

The ribs are preferably generally triangular in cross-section but they may be of other sections e.g. rectangular and segmental.

By having the ribs extending across the full width of the slabs, upward flow of molten metal behind any part of the slab is inhibited.

Commonly a hot top comprises four refractory, heat-insulating lining slabs and in accordance with the invention all the slabs may be the ribbed slabs. However in certain circumstances there may be little likelihood of molten metal rising behind one or some of the slabs and/or any penetration of molten metal behind one or some of the slabs may be unlikely to cause a significant problem. In such circumstances the slab or slabs not at risk may be conventional whilst only the slab or slabs at risk are ribbed in accordance with the invention. For example, in the case of a hot top for a slotted mould (see British Patent specification No. 936,682) comprising four slabs, only the slabs against the slotted walls may be at risk.

The slabs used in accordance with the invention may be of any refractory, heat-insulating material useful for hot top lining slabs, many such materials being known. Preferably the material comprises a refractory filler and a binder, which may be organic and/or inorganic, optionally together with fibrous material, which may be organic or inorganic. The material may also include one or more exothermic ingredients. Particularly suitable exothermic, refractory, heat-insulating compositions are described in British Patent specification 2001340A.

The slabs are preferably made by forming an aqueous slurry of ingredients as discussed above, dewatering the slurry in a suitably shaped former, drying the slab thus formed and causing or allowing the binder to set.

A refractory, heat-insulating hot top lining slab having at one surface adjacent and parallel to one edge of the slab at least two ribs extending across the slab, for use in an assembly according to the invention forms a part of the invention, as does a method of casting an ingot in which an assembly according to the invention is used.

The invention is further described with reference to the accompanying diagrammatic drawings in which.

Figure 1:
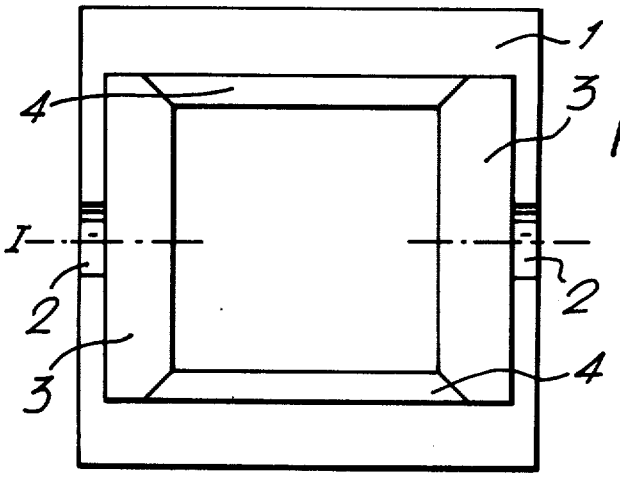
FIG. 1 is a view from above of an assembly according to the invention of a slotted ingot mould and a hot top lining in the mouth thereof.
Figure 2:
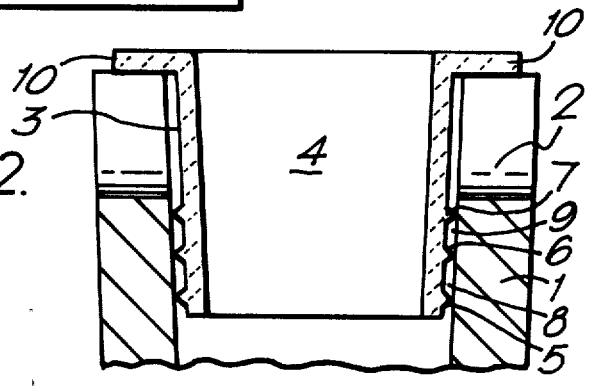
FIG. 2 is a section (showing only the upper part of the assembly) along line I—I in FIG. 1.

Referring to FIGS. 1 and 2, a wide-end up slotted ingot mould 1, having two slots 2, has in its mouth a hot top provided by four refractory, heat-insulating slabs 3, 4. The slabs have inclined side edges (see FIG. 1) and, like the internal mould wall surfaces, (see FIG. 2) these edges taper downwardly (see FIG. 3) thus enabling the slabs to be held firmly in position by a mutual wedging action.

Figure 3:
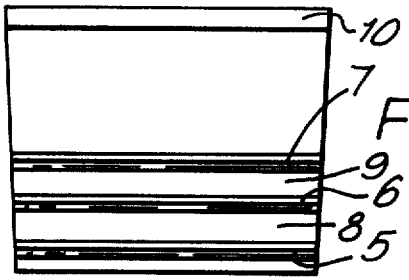
FIG. 3 is a back view of one of the slabs used in the hot top lining of the assembly of FIGS. 1 and 2.

As shown in FIGS. 2 and 3, at the back i.e. the outward-facing surface, of each of the slabs 3, adjacent to the lower edge of the slab, are three ribs 5,6,7, extending horizontally across the slab and between adjacent ribs are spaces 8,9. Each of the slabs 3 has an outwardly-projecting flange 10 at the top. The slabs 4 are generally similar to the slabs 3 except that the former have neither the ribs nor the flange.

To assemble the hot top lining, each of the two slabs 3 is put in position in the mouth of the mould with the underside of the flange resting on the top of the mould. Each of the two slabs 4 is then inserted and forced down into position to hold all the slabs firmly in position by a mutual wedging action.

When steel is teemed into the mould, any molten steel that may penetrate up behind a rib 5 finds itself in the relatively large space 8 and consequently undergoes a pressure drop. This reduces the ability of the molten steel to penetrate up behind the next rib 6 and the tendency is for the steel to solidify below the rib 6 and thereby create a seal preventing further upward flow of molten steel behind the slab. If steel does penetrate beyond the rib 6, then a further pressure drop occurs, in the relatively large space 9, and this and the next rib 7 inhibits further penetration by the steel.

Figure 4:
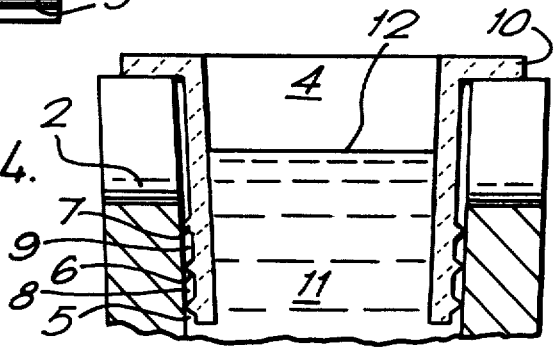
FIG. 4 is a section similar to that of FIG. 2 but showing the assembly after teeming of molten steel into the mould has been completed.
Figure 5:
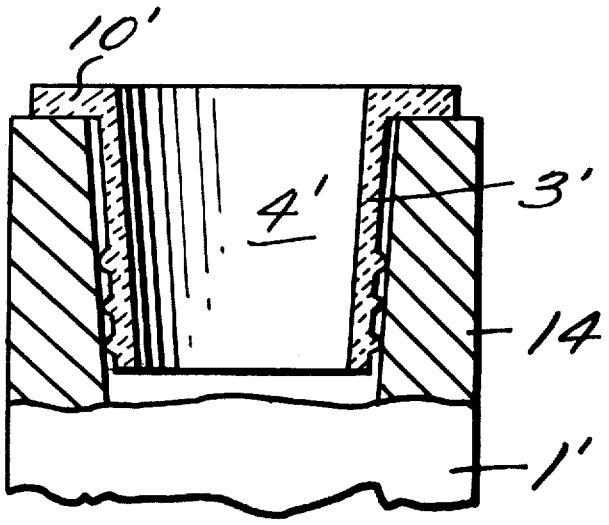
FIG. 5 is a section similar to that of FIG. 2 but illustrating a head box at the top of the mould, and a hot top lining in its mouth.

In FIG. 4, molten steel 11 has been teemed into the mould 1 up to a level 12 and no steel has penetrated up behind the slabs 3 beyond the lowermost rib 5. In FIG. 5, a head box 14 is provided at the top of the ingot mold 1'. Ribbed slabs 3' with flanges 10' cooperate with slabs 4' to provide the hot top lining.

I claim:

1. An assembly for casting metal ingots comprising: an ingot mould and a hot top lining in the mouth of said mould, said lining comprising: a plurality of refractory, heat-insulating lining slabs having a predetermined thickness and positioned in contact with the inner surface of the walls of the mouth of said mould; at least one of the said slabs having, at its outward-facing surface and adjacent to its lower edge, at least two ribs having a predetermined height and width such that said ribs extend horizontally across said slab and protrude from said outward-facing surface a distance corresponding to said predetermined height, and into contact with the mould walls, and characterized as being disposed and arranged progressively to inhibit upward flow of molten metal behind said slab, said ribs being of the same material as and integral with said slab.

2. An assembly according to claim 1 in which the lower edge of each of the plurality of slabs is exposed to molten metal rising in the mould.

3. An assembly according to claim 1 in which the plurality of slabs are wedged together.

4. An assembly for casting metal ingots comprising: an ingot mould; a head box at the top of said mould and, providing a hot top lining in said head box; a plurality of refractory, heat-insulating lining slabs having a predetermined thickness and positioned in contact with the inner surface of the walls of said head box, at least one of the said slabs having, at its outward-facing surface and adjacent to its lower edge, at least two ribs having a predetermined height and width such that said ribs extend horizontally across said slab and protrude from said outward-facing surface a distance corresponding to said predetermined height, and into contact with the head box walls, and characterized as being disposed and arranged progressively to inhibit upward flow of molten metal behind said slab, said ribs being of the same material as and integral with said slab.

5. An assembly as in claims 1, 2, 3, or 4 wherein the width of said ribs are between about 0.5 to about 1.5 times the height of said ribs.

* * * * *